US011743653B1

(12) United States Patent
Huang

(10) Patent No.: US 11,743,653 B1
(45) Date of Patent: Aug. 29, 2023

(54) DAMPING STRUCTURE TO INCREASE SPEAKER RATED POWER

(71) Applicant: Dell Products L.P., Round Rock, TX (US)

(72) Inventor: Paul Huang, New Taipei (TW)

(73) Assignee: Dell Products L.P., Round Rock, TX (US)

( * ) Notice: Subject to any disclaimer, the term of this patent is extended or adjusted under 35 U.S.C. 154(b) by 0 days.

(21) Appl. No.: 17/668,645

(22) Filed: Feb. 10, 2022

(51) Int. Cl.

| | |
|---|---|
| ***H04R 7/26*** | (2006.01) |
| ***H04R 7/12*** | (2006.01) |
| ***H04R 9/06*** | (2006.01) |
| ***H04R 7/20*** | (2006.01) |

(52) U.S. Cl.
CPC ..... *H04R 7/26* (2013.01); *H04R 7/12* (2013.01); *H04R 7/20* (2013.01); *H04R 9/06* (2013.01); *H04R 2400/11* (2013.01)

(58) Field of Classification Search
CPC ... H04R 7/12; H04R 7/20; H04R 9/06; H04R 2400/11
See application file for complete search history.

(56) References Cited

U.S. PATENT DOCUMENTS

| | | | | |
|---|---|---|---|---|
| 8,139,812 | B2 | 3/2012 | Basnet et al. | |
| 8,813,906 | B2 | 8/2014 | Ohara | |
| 2019/0261093 | A1 * | 8/2019 | Salvatti | H04R 9/06 |

* cited by examiner

*Primary Examiner* — Sunita Joshi
(74) *Attorney, Agent, or Firm* — Larson Newman, LLP

(57) ABSTRACT

A micro-speaker for an information handling system includes a frame, a speaker cone, and a suspension structure. An outside edge of the suspension structure is affixed to the frame and an inside edge of the suspension structure is affixed to the cone. The suspension structure includes a first surround structure and a second surround structure. The first surround structure is affixed to the second surround structure. The first surround structure is configured to fill a gap between the frame and the speaker cone, and the second surround structure is configured to partially fill the gap.

16 Claims, 4 Drawing Sheets

100

100

DAMPING STRUCTURE TO INCREASE SPEAKER RATED POWER

FIELD OF THE DISCLOSURE

This disclosure generally relates to speakers, and more particularly relates to a damping structure to increase speaker rated power in an information handling system.

BACKGROUND

As the value and use of information continues to increase, individuals and businesses seek additional ways to process and store information. One option is an information handling system. An information handling system generally processes, compiles, stores, and/or communicates information or data for business, personal, or other purposes. Because technology and information handling needs and requirements may vary between different applications, information handling systems may also vary regarding what information is handled, how the information is handled, how much information is processed, stored, or communicated, and how quickly and efficiently the information may be processed, stored, or communicated. The variations in information handling systems allow for information handling systems to be general or configured for a specific user or specific use such as financial transaction processing, reservations, enterprise data storage, or global communications. In addition, information handling systems may include a variety of hardware and software resources that may be configured to process, store, and communicate information and may include one or more computer systems, data storage systems, and networking systems.

SUMMARY

A micro-speaker for an information handling system may include a frame, a speaker cone, and a suspension structure. An outside edge of the suspension structure may be affixed to the frame and an inside edge of the suspension structure may be affixed to the cone. The suspension structure may include a first surround structure and a second surround structure. The first surround structure may be affixed to the second surround structure. The first surround structure may be configured to fill a gap between the frame and the speaker cone, and the second surround structure may be configured to partially fill the gap.

BRIEF DESCRIPTION OF THE DRAWINGS

It will be appreciated that for simplicity and clarity of illustration, elements illustrated in the Figures have not necessarily been drawn to scale. For example, the dimensions of some of the elements are exaggerated relative to other elements. Embodiments incorporating teachings of the present disclosure are shown and described with respect to the drawings presented herein, in which.

The use of the same reference symbols in different drawings indicates similar or identical items.

DETAILED DESCRIPTION OF DRAWINGS

The following description in combination with the Figures is provided to assist in understanding the teachings disclosed herein. The following discussion will focus on specific implementations and embodiments of the teachings. This focus is provided to assist in describing the teachings, and should not be interpreted as a limitation on the scope or applicability of the teachings. However, other teachings can certainly be used in this application. The teachings can also be used in other applications, and with several different types of architectures, such as distributed computing architectures, client/server architectures, or middleware server architectures and associated resources.

Figure 1:
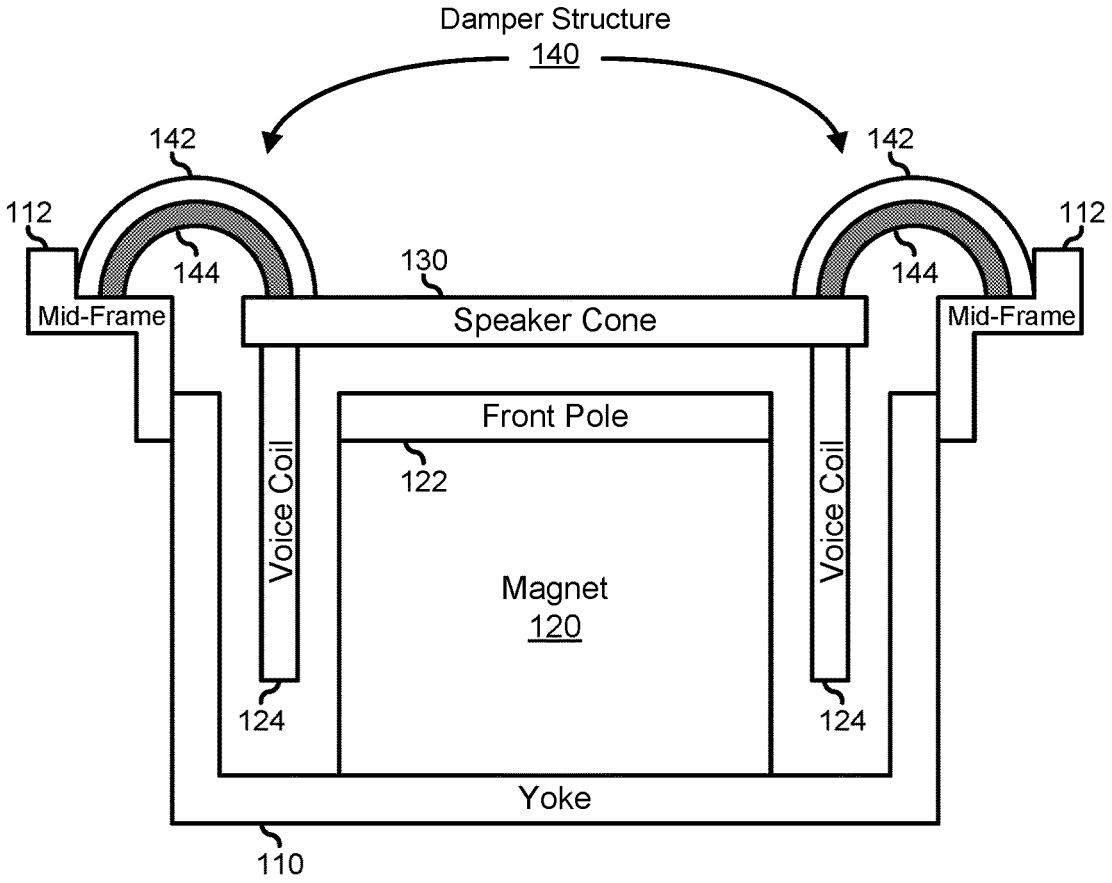
FIG. 1 illustrates a micro-speaker according to an embodiment of the current disclosure.

FIG. 1 illustrates a cut-away view of a planar type micro-speaker 100. Planar speakers may typically be found in devices where speaker size and speaker power are limited, such as in a laptop computers, tablet devices, smart phone devices or the like. For example, a planar speaker may typically be rated for peak RMS power levels of around 2 Watts. On the other hand, external audio amplifiers are typically rated for higher peak RMS power levels of around 10 Watts. It will be understood that the higher power external audio amplifiers are desirable for driving planar speakers because such amplifiers provide higher dynamic range. As such, the power gain of the external audio amplifier is typically reduced when driving a planar speaker.

Planar speaker 100 includes a yoke 110, a midframe 112, a magnet 120, a front pole 122, a voice coil 124, a speaker cone, 130, and a speaker suspension 140. Yoke 110 and midframe 112 provide the structural housing for the functional elements of planar speaker 100. The functional elements of planar speaker 100 include magnet 120 that is a fixed magnet that is attached to yoke 110, and front pole 122 is attached to the top of the magnet. Voice coil 124 is connected to an audio amplifier to receive an audio signal and operates to vibrate speaker cone 130 in response to the audio signal. Voice coil 134 and speaker cone 130 are flexibly mounted to midframe 112 by speaker suspension structure 140. The details of speaker design and particularly of planar speaker design is known in the art, and will not be further described herein, except as needed to illustrate the current embodiments.

Suspension 140 functions to suspend voice coil 124 within the gap between yoke 110 and magnet 120, and to provide a restoring force to return speaker cone 130 to a neutral position. Suspension 140 includes a primary surround 142 and a secondary surround 144. Primary and secondary surrounds 142 and 144 are fabricated of flexible polymer layers, that are typically formed of Polyether Ether Ketone (PEEK) material. As illustrated, primary surround 142 is illustrated as including a single layer, but this is not necessarily so, and it will be understood that primary surround 142 may be fabricated with two or more flexible polymer layers, as needed or desired. In particular, it will be understood that a primary surround such as primary surround 142 may be fabricated to provide the desired mechanical and acoustic properties as deemed necessary to meet the speaker specifications.

It will be understood that a larger number of polymer layers, or thicker polymer in a primary surround will stiffen the suspension structure. A stiffer structure may be provided in order to permit higher peak RMS power operation of the associated loudspeaker. However, such stiffening may have an adverse effect of reducing the dynamic range of the loudspeaker. As such, a number of polymer layers, or the thickness of a primary surround may be selected in order to optimize between the rated power level and the sound quality of the particular loudspeaker. The details of loudspeaker suspension design are known in the art, and will not be further described herein, except as needed to illustrate the current embodiments.

Figure 2:
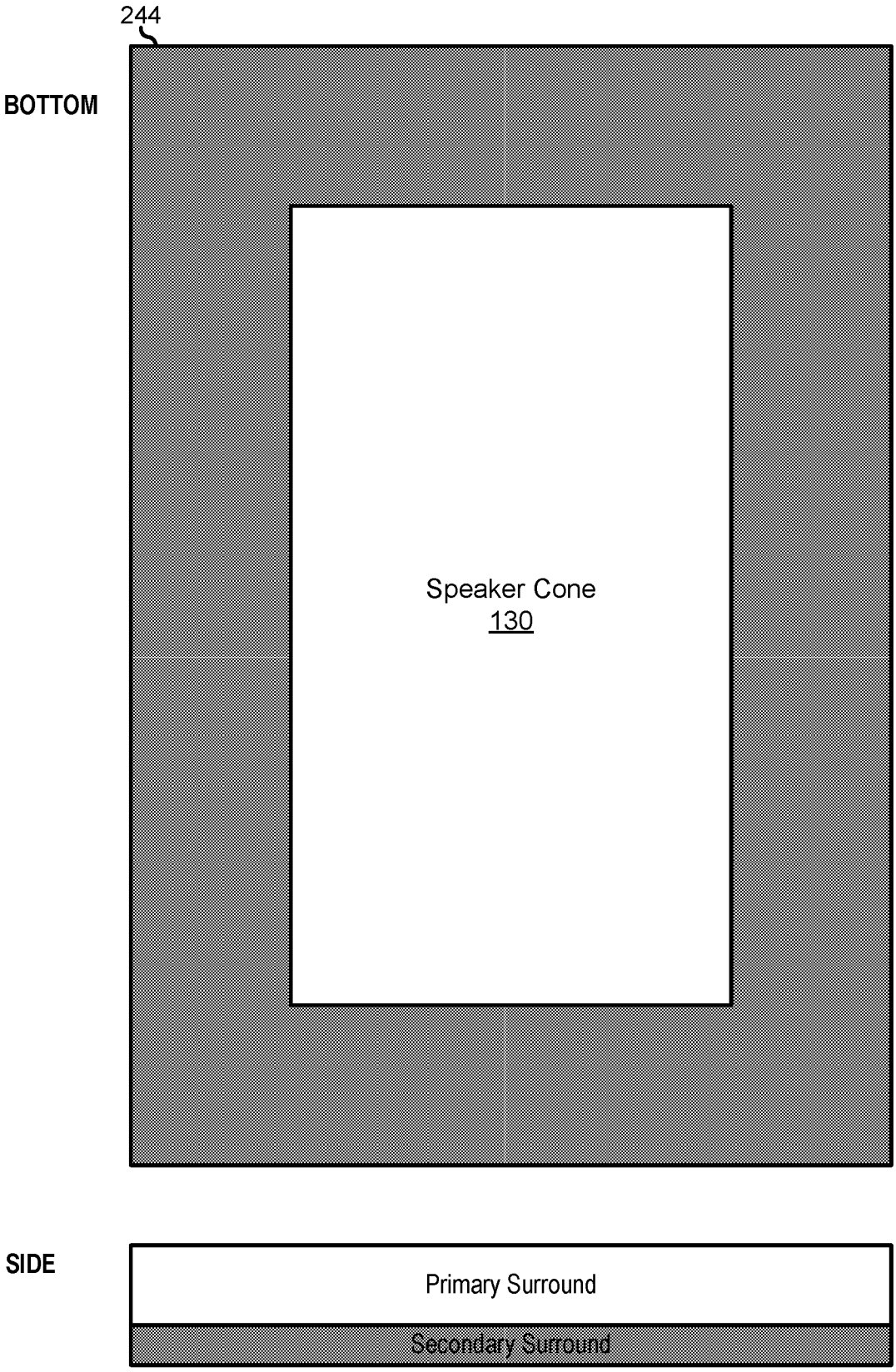
FIG. 2 illustrates a surround structure of a support structure for a micro-speaker according to an embodiment of the current disclosure.

Secondary surround 144 represents an additional layer of the polymer material that is selectively applied to stiffen suspension 140 to permit operation of micro-speaker 100, without greatly reducing the dynamic range of the micro-speaker. In a particular embodiment, as illustrated in FIG. 2, a secondary surround 244 similar to secondary surround 144 is fabricated as a layer of polymer material that is thinner than the polymer material of primary surround 142. In this way, a degree of stiffening of suspension 140 can be achieved in smaller degrees than would otherwise be enabled by utilizing an additional layer of the same thickness as primary surround 142, and thus a higher dynamic range may be achieved. In addition, where the thickness of primary surround 142 is significantly greater than the thickness of secondary surround 244, then the secondary surround may be fabricated of multiple layers of the polymer material in order to achiever a higher degree of design flexibility to choose between stiffness for higher power level, and dynamic range, as needed or desired.

Figure 3:
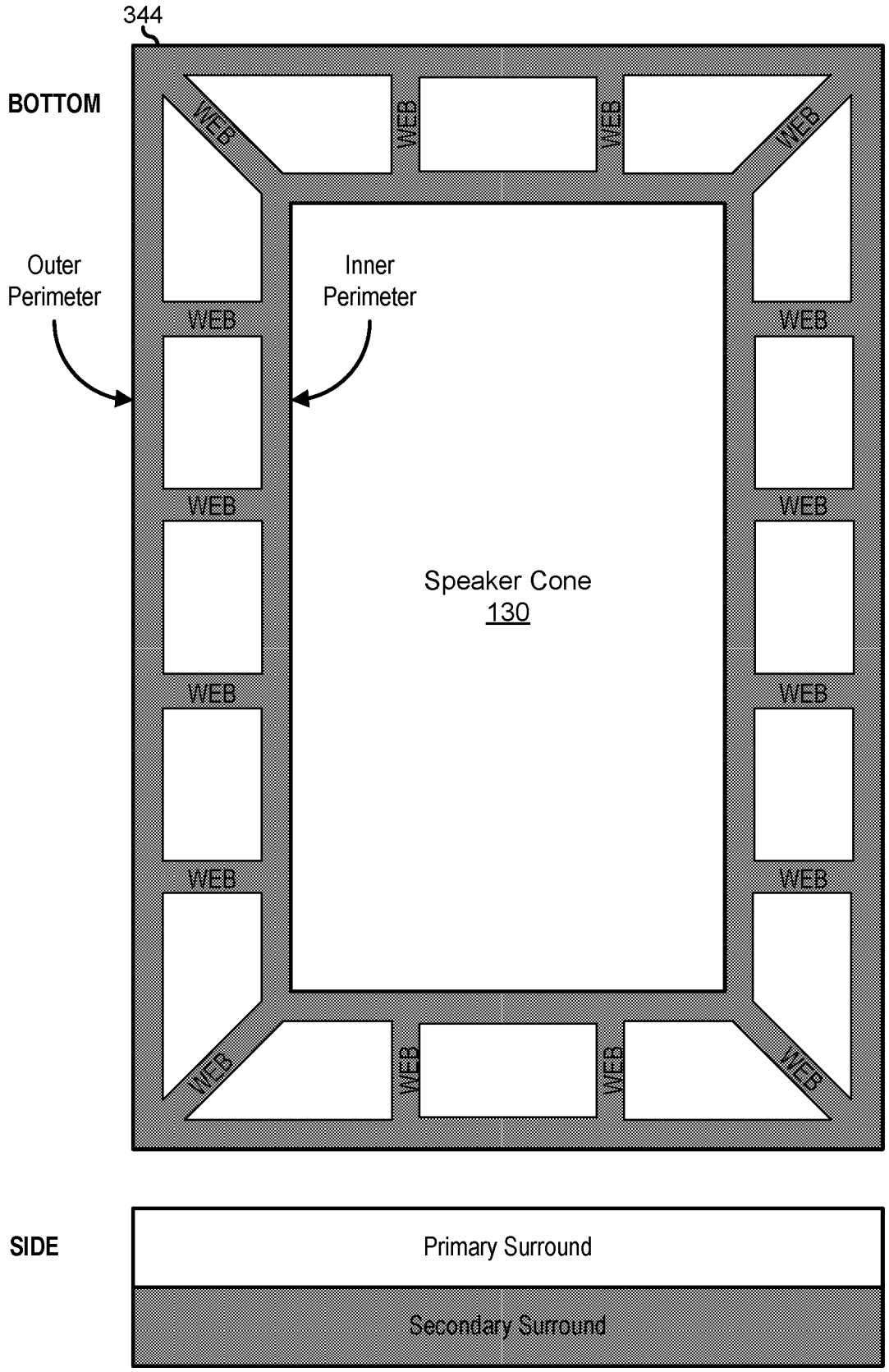
FIG. 3 illustrates a surround structure of a support structure for a micro-speaker according to another embodiment of the current disclosure.

In another embodiment, as illustrated in FIG. 3, a secondary surround 344 similar to secondary surround 144 is fabricated of a polymer material of the same thickness as the polymer material of primary surround 142. However, secondary surround 344 is patterned to remove portions of the polymer material layer, thereby forming the secondary surround in a spider-web pattern. Here, a first surround portion of the polymer material of secondary surround 344 is formed that provides a contiguous perimeter around the outside edges of the secondary surround that is affixed to yoke 110. A second surround portion of the polymer material is formed that provides a contiguous perimeter around the inside edge of the secondary surround that is affixed to cone 130.

A number of web portions are formed that provide interconnections between the outer portion and the inner portion of the secondary surround. The web portions provide additional stiffness to suspension 140 and the degree of stiffness may be determined by the number and configuration of the web portions. It will be understood that secondary surround 344 as illustrated in this embodiment may include one or more additional surround portions interspersed between the first and second surround portions, as needed or desired.

Secondary surround 344 may be fabricated by any process suitable to form the spider-web pattern as may be known in the art, as needed or desired. For example, secondary surround 344 may be fabricated from a layer of polymer material by a laser etch process, a cutting or stamping process, or another process to remove unwanted polymer material, as needed or desired. Further, a secondary surround similar to secondary surround 144, secondary surround 244, or secondary surround 344 may be affixed to an associated primary surround by any process suitable to adhere polymer material layers together as may be known in the art, as needed or desired.

In another embodiment, a suspension that includes a secondary surround similar to secondary surround 344 may be fabricated in a single fabrication process with the associated primary suspend. For example, a mold in the form of the finished surround, including a spider-web pattern, may be formed, and polymer beads added to the mold and cured to form the suspension as a single element that includes the features of a primary surround and a secondary surround together, as described above, as needed or desired. It will be understood that a suspension may be formed with a spider-web pattern on a bottom side of the suspension, as illustrated in the current embodiments, or may be formed with a spider-web pattern on a top side of the suspension, or on both the top and bottom sides of the suspension, as needed or desired.

Figure 4:
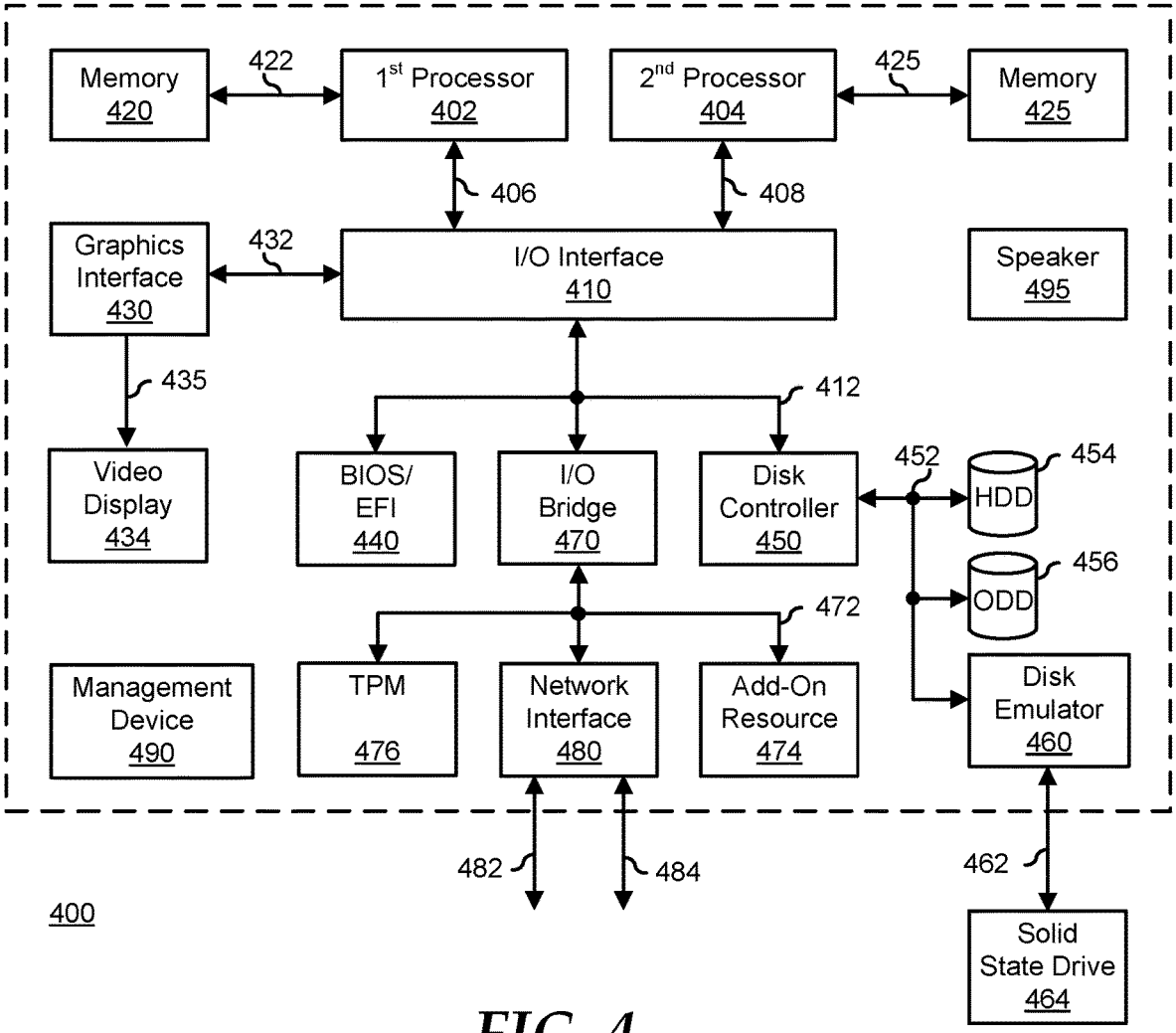
FIG. 4 is a block diagram illustrating a generalized information handling system according to another embodiment of the present disclosure.

FIG. 4 illustrates a generalized embodiment of an information handling system 400. For purpose of this disclosure an information handling system can include any instrumentality or aggregate of instrumentalities operable to compute, classify, process, transmit, receive, retrieve, originate, switch, store, display, manifest, detect, record, reproduce, handle, or utilize any form of information, intelligence, or data for business, scientific, control, entertainment, or other purposes. For example, information handling system 400 can be a personal computer, a laptop computer, a smart phone, a tablet device or other consumer electronic device, a network server, a network storage device, a switch router or other network communication device, or any other suitable device and may vary in size, shape, performance, functionality, and price. Further, information handling system 400 can include processing resources for executing machine-executable code, such as a central processing unit (CPU), a programmable logic array (PLA), an embedded device such as a System-on-a-Chip (SoC), or other control logic hardware. Information handling system 400 can also include one or more computer-readable medium for storing machine-executable code, such as software or data. Additional components of information handling system 400 can include one or more storage devices that can store machine-executable code, one or more communications ports for communicating with external devices, and various input and output (I/O) devices, such as a keyboard, a mouse, and a video display. Information handling system 400 can also include one or more buses operable to transmit information between the various hardware components.

Information handling system 400 can include devices or modules that embody one or more of the devices or modules described below, and operates to perform one or more of the methods described below. Information handling system 400 includes a processors 402 and 404, an input/output (I/O) interface 410, memories 420 and 425, a graphics interface 430, a basic input and output system/universal extensible firmware interface (BIOS/UEFI) module 440, a disk controller 450, a hard disk drive (HDD) 454, an optical disk drive (ODD) 456, a disk emulator 460 connected to an external solid state drive (SSD) 462, an I/O bridge 470, one or more add-on resources 474, a trusted platform module (TPM) 476, a network interface 480, a management device 490, and speaker 495. Processors 402 and 404, I/O interface 410, memory 420, graphics interface 430, BIOS/UEFI module 440, disk controller 450, HDD 454, ODD 456, disk emulator 460, SSD 462, I/O bridge 470, add-on resources 474, TPM 476, and network interface 480 operate together to provide a host environment of information handling system 400 that operates to provide the data processing functionality of the information handling system. The host environment operates to execute machine-executable code, including platform BIOS/UEFI code, device firmware, operating system code, applications, programs, and the like, to perform the data processing tasks associated with information handling system 400.

In the host environment, processor 402 is connected to I/O interface 410 via processor interface 406, and processor 404 is connected to the I/O interface via processor interface 408. Memory 420 is connected to processor 402 via a memory interface 422. Memory 425 is connected to processor 404 via a memory interface 427. Graphics interface 430 is connected to I/O interface 410 via a graphics interface 432, and provides a video display output 436 to a video display 434. In a particular embodiment, information handling system 400 includes separate memories that are dedicated to each of processors 402 and 404 via separate memory interfaces. An example of memories 420 and 430 include random access memory (RAM) such as static RAM (SRAM), dynamic RAM (DRAM), non-volatile RAM (NV-RAM), or the like, read only memory (ROM), another type of memory, or a combination thereof.

BIOS/UEFI module 440, disk controller 450, and I/O bridge 470 are connected to I/O interface 410 via an I/O channel 412. An example of I/O channel 412 includes a Peripheral Component Interconnect (PCI) interface, a PCI-Extended (PCI-X) interface, a high-speed PCI-Express (PCIe) interface, another industry standard or proprietary communication interface, or a combination thereof. I/O interface 410 can also include one or more other I/O interfaces, including an Industry Standard Architecture (ISA) interface, a Small Computer Serial Interface (SCSI) interface, an Inter-Integrated Circuit ($I^2C$) interface, a System Packet Interface (SPI), a Universal Serial Bus (USB), another interface, or a combination thereof. BIOS/UEFI module 440 includes BIOS/UEFI code operable to detect resources within information handling system 400, to provide drivers for the resources, initialize the resources, and access the resources. BIOS/UEFI module 440 includes code that operates to detect resources within information handling system 400, to provide drivers for the resources, to initialize the resources, and to access the resources.

Disk controller 450 includes a disk interface 452 that connects the disk controller to HDD 454, to ODD 456, and to disk emulator 460. An example of disk interface 452 includes an Integrated Drive Electronics (IDE) interface, an Advanced Technology Attachment (ATA) such as a parallel ATA (PATA) interface or a serial ATA (SATA) interface, a SCSI interface, a USB interface, a proprietary interface, or a combination thereof. Disk emulator 460 permits SSD 464 to be connected to information handling system 400 via an external interface 462. An example of external interface 462 includes a USB interface, an IEEE 1394 (Firewire) interface, a proprietary interface, or a combination thereof. Alternatively, solid-state drive 464 can be disposed within information handling system 400.

I/O bridge 470 includes a peripheral interface 472 that connects the I/O bridge to add-on resource 474, to TPM 476, and to network interface 480. Peripheral interface 472 can be the same type of interface as I/O channel 412, or can be a different type of interface. As such, I/O bridge 470 extends the capacity of I/O channel 412 when peripheral interface 472 and the I/O channel are of the same type, and the I/O bridge translates information from a format suitable to the I/O channel to a format suitable to the peripheral channel 472 when they are of a different type. Add-on resource 474 can include a data storage system, an additional graphics interface, a network interface card (NIC), a sound/video processing card, another add-on resource, or a combination thereof. Add-on resource 474 can be on a main circuit board, on separate circuit board or add-in card disposed within information handling system 400, a device that is external to the information handling system, or a combination thereof.

Network interface 480 represents a NIC disposed within information handling system 400, on a main circuit board of the information handling system, integrated onto another component such as I/O interface 410, in another suitable location, or a combination thereof. Network interface device 480 includes network channels 482 and 484 that provide interfaces to devices that are external to information handling system 400. In a particular embodiment, network channels 482 and 484 are of a different type than peripheral channel 472 and network interface 480 translates information from a format suitable to the peripheral channel to a format suitable to external devices. An example of network channels 482 and 484 includes InfiniBand channels, Fibre Channel channels, Gigabit Ethernet channels, proprietary channel architectures, or a combination thereof. Network channels 482 and 484 can be connected to external network resources (not illustrated). The network resource can include another information handling system, a data storage system, another network, a grid management system, another suitable resource, or a combination thereof.

Management device 490 represents one or more processing devices, such as a dedicated baseboard management controller (BMC) System-on-a-Chip (SoC) device, one or more associated memory devices, one or more network interface devices, a complex programmable logic device (CPLD), and the like, that operate together to provide the management environment for information handling system 400. In particular, management device 490 is connected to various components of the host environment via various internal communication interfaces, such as a Low Pin Count (LPC) interface, an Inter-Integrated-Circuit (I2C) interface, a PCIe interface, or the like, to provide an out-of-band (00B) mechanism to retrieve information related to the operation of the host environment, to provide BIOS/UEFI or system firmware updates, to manage non-processing components of information handling system 400, such as system cooling fans and power supplies. Management device 490 can include a network connection to an external management system, and the management device can communicate with the management system to report status information for information handling system 400, to receive BIOS/UEFI or system firmware updates, or to perform other task for managing and controlling the operation of information handling system 400. Management device 490 can operate off of a separate power plane from the components of the host environment so that the management device receives power to manage information handling system 400 when the information handling system is otherwise shut down. An example of management device 490 include a commercially available BMC product or other device that operates in accordance with an Intelligent Platform Management Initiative (IPMI) specification, a Web Services Management (WSMan) interface, a Redfish Application Programming Interface (API), another Distributed Management Task Force (DMTF), or other management standard, and can include an Integrated Dell Remote Access Controller (iDRAC), an Embedded Controller (EC), or the like. Management device 490 may further include associated memory devices, logic devices, security devices, or the like, as needed or desired.

Although only a few exemplary embodiments have been described in detail herein, those skilled in the art will readily appreciate that many modifications are possible in the exemplary embodiments without materially departing from the novel teachings and advantages of the embodiments of the present disclosure. Accordingly, all such modifications are intended to be included within the scope of the embodiments of the present disclosure as defined in the following claims. In the claims, means-plus-function clauses are intended to cover the structures described herein as performing the recited function and not only structural equivalents, but also equivalent structures.

The above-disclosed subject matter is to be considered illustrative, and not restrictive, and the appended claims are intended to cover any and all such modifications, enhancements, and other embodiments that fall within the scope of the present invention. Thus, to the maximum extent allowed by law, the scope of the present invention is to be determined by the broadest permissible interpretation of the following claims and their equivalents, and shall not be restricted or limited by the foregoing detailed description.

What is claimed is:

1. A micro-speaker for an information handling system, the micro-speaker comprising:

a frame;

a speaker cone; and a suspension structure, an outside edge of the suspension structure affixed to the frame and an inside edge of the suspension structure affixed to the cone, the suspension structure including a first surround structure and a second surround structure, the first surround structure being affixed to the second surround structure, the first surround structure configured to fill a gap between the frame and the speaker cone, and the second surround structure configured in a spider-web pattern having an outer perimeter portion proximate to the frame, an inner perimeter portion proximate to the speaker cone, and at least one web portion formed between the outer perimeter and the inner perimeter.

2. The micro-speaker of claim 1, wherein the first and second surround structures are formed of flexible polymer material.

3. The micro-speaker of claim 2, wherein the first surround structure includes a first layer of the flexible polymer material of a particular thickness, and wherein the second surround structure includes a second layer of the flexible polymer material of the particular thickness.

4. The micro-speaker of claim 3, wherein the first surround structure includes at least one additional layer of the flexible polymer material of the particular thickness.

5. The micro-speaker of claim 2, wherein the flexible polymer material is a Polyether Ether Ketone material.

6. The micro-speaker of claim 1, the second surround structure further having at least one additional perimeter portion between the outer perimeter portion and the inner perimeter portion.

7. The micro-speaker of claim 1, wherein the first surround structure is adhered to the second surround structure.

8. The micro-speaker of claim 7, wherein in adhering the first surround structure to the second surround structure, the second surround structure operates to stiffen the suspension structure to provide a higher peak power capacity of the micro-speaker.

9. A method, comprising:

affixing, to a frame of a micro-speaker, an outer edge of a suspension structure; and affixing, to a speaker cone of the micro-speaker, an inner edge of the suspension structure, wherein the suspension structure includes a first surround structure and a second surround structure, the first surround structure being affixed to the second surround structure, the first surround structure configured to fill a gap between the frame and the speaker cone, and the second surround structure configured to partially fill the gap, wherein the first surround structure is adhered to the second surround structure, and wherein in adhering the first surround structure to the second surround structure, the second surround structure operates to stiffen the suspension structure to provide a higher peak power capacity of the micro-speaker.

10. The method of claim 9, further comprising forming the first and second surround structures of flexible polymer material.

11. The method of claim 10, further comprising wherein the first surround structure includes a first layer of the flexible polymer material of a particular thickness, and wherein the second surround structure includes a second layer of the flexible polymer material of the particular thickness.

12. The method of claim 11, wherein the first surround structure includes at least one additional layer of the flexible polymer material of the particular thickness.

13. The method of claim 10, wherein the flexible polymer material is a Polyether Ether Ketone material.

14. The method of claim 9 wherein, in partially filling the gap, the second surround structure is further configured in a spider-web pattern having an outer perimeter portion proximate to the frame, an inner perimeter portion proximate to the speaker cone, and at least one web portion formed between the outer perimeter and the inner perimeter.

15. The method of claim 14, the second surround structure further having at least one additional perimeter portion between the outer perimeter portion and the inner perimeter portion.

16. A micro-speaker for an information handling system, the micro-speaker comprising:

a frame;

a speaker cone;

a voice coil affixed to the speaker cone; and a suspension structure, an outside edge of the suspension structure affixed to the frame and an inside edge of the suspension structure affixed to the cone, the suspension structure including a first surround structure and a second surround structure, the first surround structure being affixed to the second surround structure, the first surround structure configured to fill a gap between the frame and the speaker cone, and the second surround structure configured in a spider-web pattern having an outer perimeter portion proximate to the frame, an inner perimeter portion proximate to the speaker cone, and at least one web portion formed between the outer perimeter and the inner perimeter, wherein the first and second surround structures are formed of flexible polymer material.

* * * * *